US010470637B2

(12) United States Patent
Runnoe et al.

(10) Patent No.: US 10,470,637 B2
(45) Date of Patent: Nov. 12, 2019

(54) SURFACE MAINTENANCE MACHINE WITH AN AUXILIARY WASTE REMOVAL SYSTEM

(71) Applicant: Tennant Company, Minneapolis, MN (US)

(72) Inventors: Adam J. C. Runnoe, Minneapolis, MN (US); Justin I. Dancs, Plymouth, MN (US); Laurence A. Jensen, Oakdale, MN (US); Erik M. Weatherly, Minnetonka, MN (US)

(73) Assignee: Tennant Company, Minneapolis, MN (US)

( * ) Notice: Subject to any disclaimer, the term of this patent is extended or adjusted under 35 U.S.C. 154(b) by 155 days.

(21) Appl. No.: 15/421,888

(22) Filed: Feb. 1, 2017

(65) Prior Publication Data

US 2017/0224184 A1 Aug. 10, 2017

Related U.S. Application Data

(60) Provisional application No. 62/291,998, filed on Feb. 5, 2016.

(51) Int. Cl.
*A47L 11/40* (2006.01)
*A47L 11/30* (2006.01)
(Continued)

(52) U.S. Cl.
CPC ..... *A47L 11/4044* (2013.01); *A47L 11/4011* (2013.01); *A47L 11/4013* (2013.01); *E01H 1/0827* (2013.01); *E01H 1/0845* (2013.01)

(58) Field of Classification Search
CPC ..... A47L 11/4044; A47L 11/11; A47L 11/24; A47L 11/282; A47L 11/302;
(Continued)

(56) References Cited

U.S. PATENT DOCUMENTS 3,029,461 A 4/1962 Osborn
3,079,626 A 3/1963 Yonkers et al.
(Continued)

OTHER PUBLICATIONS

Tennant Company, "Brochure, Compact Rider Sweeper Model 6200," available online at https://www.tennantco.com/content/dam/tennant/tennantco/products/machines/sweeper%20riders/6200/6200-brochure-en-noam.pdf, Feb. 2014, 4 pages.
(Continued)

*Primary Examiner* — Dung Van Nguyen
(74) *Attorney, Agent, or Firm* — Fredrikson & Byron P.A.

(57) ABSTRACT

An auxiliary waste removal system for a surface maintenance machine, having a vacuum wand for removing waste from the floor surface, a reusable bagless waste collection container removably coupled to the vacuum wand, and a vacuum source fluidly coupled to the bagless waste collection container, the vacuum source generating a vacuum flow from an inlet of the vacuum wand to a vacuum outlet, the vacuum outlet being positioned downstream of the bagless waste collection container and the vacuum source such that the waste suctioned from the floor surface by the vacuum wand travels along the vacuum flow path and is directly received in the bagless waste collection container.

23 Claims, 14 Drawing Sheets

(51) Int. Cl.
*A47L 11/24* (2006.01)
*E01H 1/08* (2006.01)

(58) Field of Classification Search
CPC ..... A47L 11/4011; A47L 11/4013; A47L 11/4061; A47L 11/4066; A47L 11/4083; E01H 1/0827; E01H 1/0845
See application file for complete search history.

(56) References Cited

U.S. PATENT DOCUMENTS 4,433,532 A * 2/1984 McCunn ..... A01D 43/077 15/340.1
4,535,501 A * 8/1985 Hollowell ..... E01H 1/0836 15/339
4,868,948 A * 9/1989 Arnold ..... A47L 9/0072 15/340.1
6,041,471 A * 3/2000 Charky ..... A47L 11/24 15/320
6,269,518 B1 8/2001 Yung
6,484,350 B2 11/2002 Yung
7,222,392 B2 5/2007 McCormick et al.
8,584,294 B2 11/2013 Loring
2009/0064452 A1* 3/2009 Thatcher ..... A47L 11/10 15/364
2011/0108067 A1* 5/2011 Shinler ..... A47L 11/4044 134/21

OTHER PUBLICATIONS

Tennant Company, "Parts Manual, Compact Rider Sweeper Model 6200, Vacuum Wand Group" available online at https://www.tennantco.com/content/dam/tennant/tennantco/products/machines/sweeper%20riders/6200/operator-parts-manual/330410.pdf, Sep. 1999, pp. 3-4 to 3-11 (9 pages).

* cited by examiner

SURFACE MAINTENANCE MACHINE WITH AN AUXILIARY WASTE REMOVAL SYSTEM

RELATED APPLICATION

This application claims the benefit of U.S. Provisional Patent Application No. 62/291,998 filed Feb. 5, 2016, the entire content of which is hereby incorporated by reference.

BACKGROUND

Surface maintenance machines for relatively large floor areas, for example, of commercial, industrial, public or institutional spaces, are typically integrated with an operator-driven vehicle. These machines can be a floor scrubbing machine or a floor sweeping machine. Commercially available examples of such machines include models T7, T17 and T20 Rider-Scrubbers, and the models M20 and M30 Integrated Scrubber-Sweepers, all available from Tennant Company of Minneapolis, Minn. Other machines, such as polishing, burnishing or outdoor litter collecting machines can also perform other surface maintenance operations such as cleaning (e.g., sweeping, scrubbing, etc.) polishing, burnishing, buffing, stripping and the like on surfaces such as floors, hallways, etc. of buildings, roads, pavements, sidewalks and the like.

Many types of cleaning machines typically do not have an auxiliary waste removal system that allows an operator to remove waste away from a cleaning path of the machine. Still further, machines that have an auxiliary waste removal system use disposable bags for collecting waste that may be costly or lead to a higher environmental impact due to the use of disposable bags that may not be recyclable or reusable.

SUMMARY

In one aspect, the present disclosure includes a surface maintenance machine comprising a primary waste removal system for removal of waste generated from the floor surface maintenance operation. The surface maintenance machine also includes an auxiliary waste removal system comprising, a vacuum wand, a bagless waste collection container fluidly coupled to the vacuum wand, and a vacuum source fluidly coupled to the bagless waste collection container. The vacuum source can generate a vacuum flow from an inlet of the vacuum wand toward an exhaust port. The exhaust port can be located interior to the body of the machine.

In another aspect, the bagless waste collection container can be disposed about a longitudinal centerline. The vacuum source can be fluidly coupled to the bagless waste collection container. The vacuum source may generate a vacuum flow path defined from a bagless waste collection container inlet to a bagless waste collection container outlet, such that the waste suctioned from a floor surface travels along the vacuum flow path and is directly received in the bagless waste collection container. The bagless waste collection container inlet can be in-line with the longitudinal centerline of the bagless waste collection container. The bagless waste collection container outlet can be offset from the longitudinal centerline of the bagless waste collection container.

In a further aspect, the auxiliary waste removal system can include a vacuum wand fluidly coupled to and positioned upstream of the waste collection container inlet. The vacuum wand can be supported by a telescoping spine configured to be collapsible or extensible, such that the vacuum wand collapses or extends with the telescoping spine.

The details of one or more examples are set forth in the accompanying drawings and the description below. Other features, objects, and advantages will be apparent from the description and drawings.

DETAILED DESCRIPTION

Figure 1:
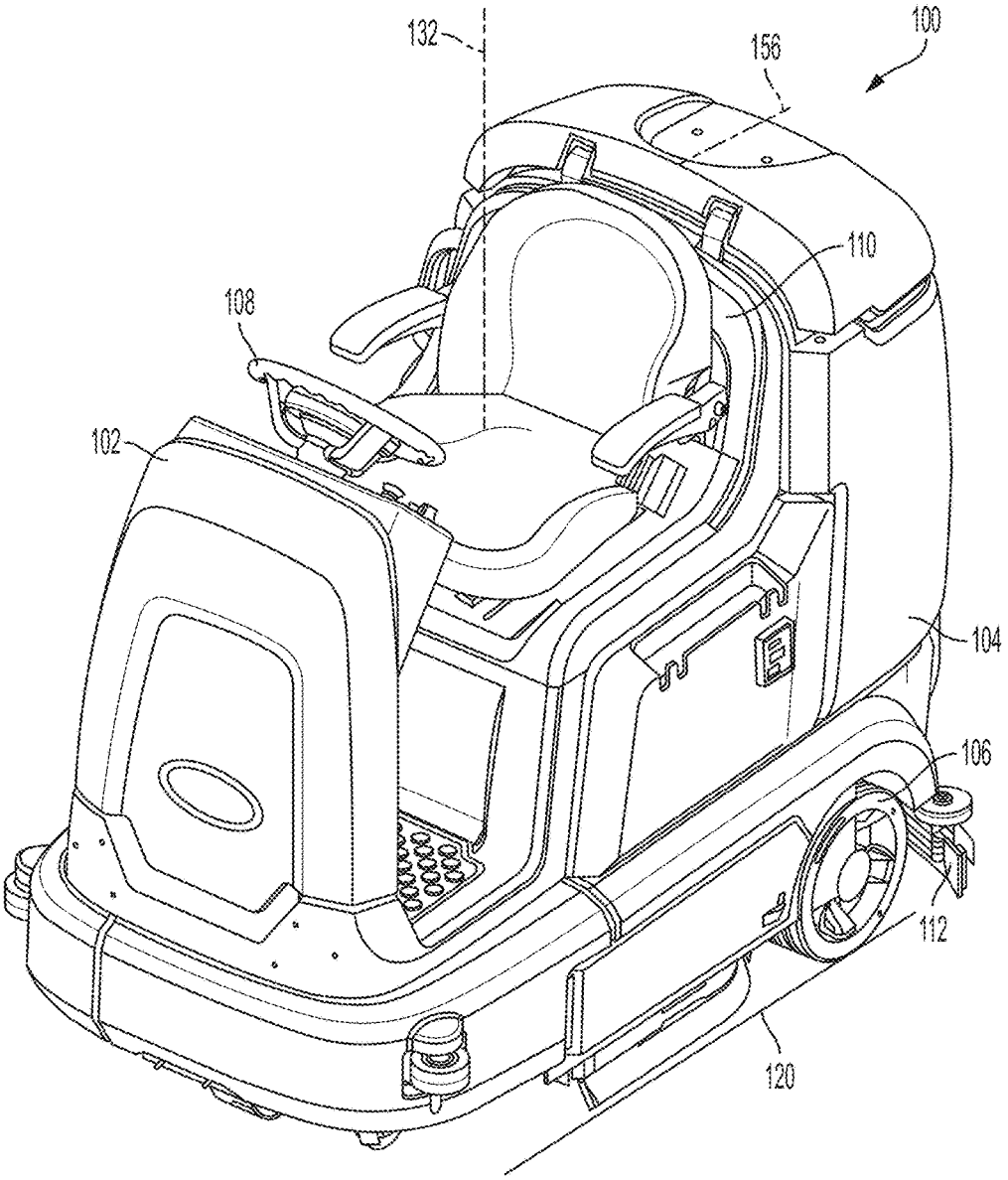
FIG. 1 is a perspective view of an exemplary surface maintenance machine according to an embodiment.

FIG. 1 is a perspective view of an exemplary surface maintenance machine 100. In the illustrated embodiment shown in FIG. 1, the surface maintenance machine 100 is s a ride-on machine 100. The surface maintenance machine 100 can perform maintenance tasks such as sweeping, scrubbing, polishing (burnishing) a surface. The surface can be a floor surface 120, pavement, road surface and the like. Embodiments of the surface maintenance machine 100 include components that are supported on a mobile body 102. As best seen in FIG. 1, the mobile body 102 comprises a frame 104 supported on wheels 106 for travel over a surface, on which a surface maintenance operation is to be performed. The mobile body 102 may include operator controls (not shown) and a steering control such as a steering wheel 108. Additionally, the machine 100 includes an operator cabin 110 for seating an operator (e.g., in a seat) who may grasp and steer the steering wheel 108 to steer the machine 100, or engage one or more operator controls to control the machine 100 to perform one or more cleaning operations. The surface maintenance machine 100 can be powered by an on-board power source such as one or more batteries or an internal combustion engine (not shown). The power source can be proximal to the front of the surface maintenance machine 100, or it may instead be located elsewhere, such as within the interior of the surface maintenance machine 100, supported within the frame 104, and/or proximate the rear of the surface maintenance machine 100. Alternatively, the surface maintenance machine 100 can be powered by an external electrical source (e.g., a power generator) via an electrical outlet. The interior of the surface maintenance machine 100 can include electrical connections (not shown) for transmission and control of various components.

While not shown in detail in FIG. 1, the surface maintenance machine 100 includes a maintenance head assembly. The maintenance head assembly houses one or more surface maintenance tools such as scrub brushes, sweeping brushes, and polishing, stripping or burnishing pads. For example, the maintenance head is a cleaning head comprising one or more cleaning tools (e.g., sweeping or scrubbing brushes). Alternatively, the maintenance head is a treatment head comprising one or more treatment tools (e.g., polishing, stripping or buffing pads). Many different types of surface maintenance tools are used to perform one or more maintenance operations on the floor surface 120. These include sweeping, scrubbing brushes, polishing/burnishing and/or buffing pads. Additionally, one or more side brushes for performing sweeping, scrubbing or other operations can be provided. The maintenance head assembly can be attached to the base of the surface maintenance machine 100 such that the head can be lowered to an operating position and raised to a traveling position. The maintenance head assembly is connected to the surface maintenance machine 100 using any known mechanism, such as a suspension and lift mechanism such as those illustrated in U.S. Pat. No. 8,584,294 assigned to Tennant Company of Minneapolis, Minn., the disclosure of each of which is hereby incorporated by reference in its entirety.

In some embodiments, the interior of the surface maintenance machine 100 can include a primary waste removal system for removal of debris from the surface. In such embodiments, the interior can include a fluid source tank (not shown) and a fluid recovery tank (not shown). The fluid source tank can include a fluid source such as a cleaner or sanitizing fluid that can be applied to the floor surface 120 during treating operations. The fluid recovery tank holds recovered fluid source that has been applied to the floor surface 120 and soiled. The interior of the surface maintenance machine 100 can include passageways (not shown) for passage of debris and dirty water. In some such cases, the primary waste removal system can be fluidly coupled to the recovery tank for drawing dirt, debris or soiled water from the surface. The primary waste removal system may comprise a vacuum-assisted squeegee 112 mounted to extend from a lower rearward portion of machine 100. Fluid, for example, clean water, which may be mixed with a detergent, can be dispensed from the scrubbing fluid tank to the floor beneath machine 100, in proximity to the scrubbing brushes, and soiled scrubbing fluid is drawn by the squeegee centrally, after which it is suctioned via a recovery hose into the recovery tank. Machine 100 can also include a feedback control system to operate these and other elements of machine 100, according to apparatus and methods which are known to those skilled in the art.

In alternative embodiments, the surface maintenance machine 100 may be combination sweeper and scrubber machine. In such embodiments, in addition to the elements describe above, the machine 100 may either be an air sweeper-scrubber or a mechanical sweeper-scrubber. Such machines can also include sweeping brushes (e.g., rotary broom) extending from the underside of the machine 100, with the sweeping brushes designed to direct dirt and debris into a hopper. In the cases of an air sweeper-scrubber, the machine 100 can also include a vacuum system for suctioning dirt and debris from the floor surface 120. In still other embodiments, the machine 100 may be a sweeper. In such embodiments, the machine 100 may include the elements as described above for a sweeper and scrubber machine 100, but would not include the scrubbing elements such as scrubbers, squeegees and fluid storage tanks (for detergent, recovered fluid and clean water).

Figure 2:
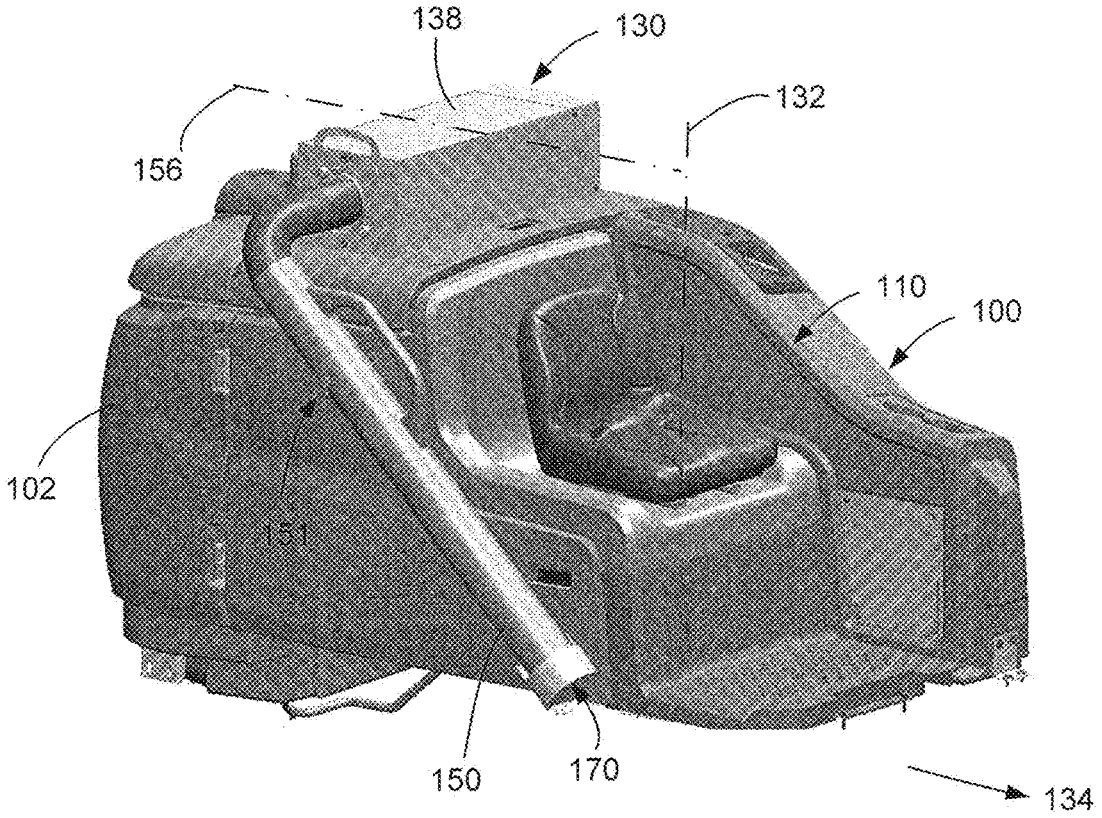
FIG. 2 is a perspective view of the floor surface machine of FIG. 1 shown along with an auxiliary waste removal system.

Referring now to the detailed perspective view of FIG. 2, the machine 100 includes an auxiliary waste removal system 130. In the embodiment illustrated in FIG. 2, the auxiliary waste removal system 130 is positioned to the rear of a transverse centerline 132 of the machine 100 when viewed from a forward direction of travel 134 of the machine 100. Such an embodiment can facilitate removal of waste that may not be picked up by the machine 100's primary waste removal system such as loose debris present laterally to the side of the machine 100 and away from the machine 100's cleaning path.

Figure 3:
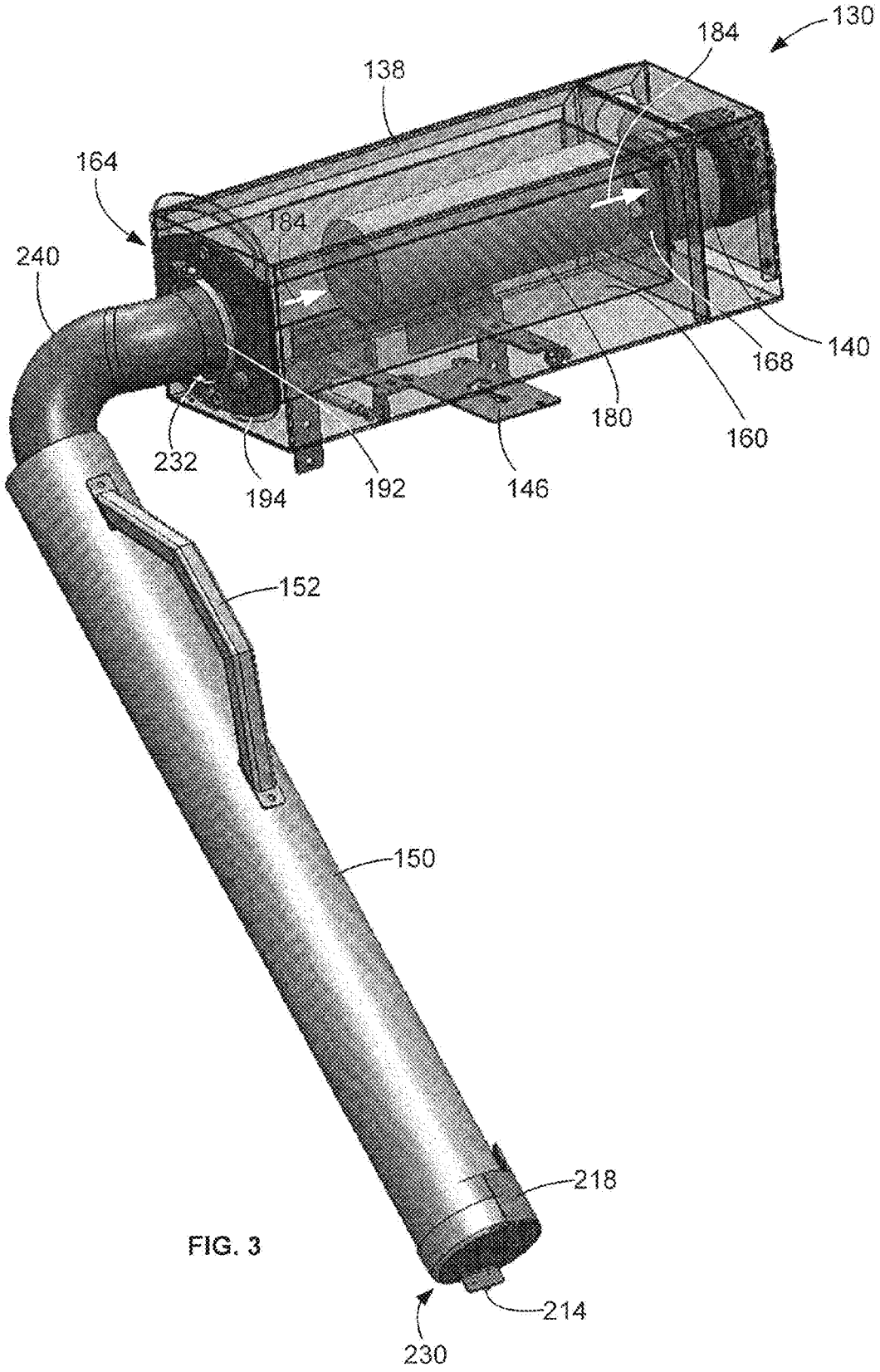
FIG. 3 is a perspective view of an auxiliary waste removal system according to an embodiment.

FIG. 3 shows a perspective view of the auxiliary waste removal system 130 according to an embodiment. In this view, the outer enclosure 138 of the auxiliary waste removal system 130 is shown as a transparent component to illustrate internal detail. As shown in FIG. 3, the auxiliary waste removal system 130 can comprise a vacuum source 140. The vacuum source has a vacuum inlet 142 disposed along a central axis 143. In some cases, the vacuum source 140 can be operatively coupled to and driven by the main power source of the surface maintenance machine 100. For example, the vacuum source 140 can be a fan, and the main power source of the surface maintenance machine 100 can be a battery 144 (e.g., as illustrated in FIG. 4B). In such cases, the fan can be powered by the battery 144. Such embodiments advantageously prevent the use of additional power sources to power the auxiliary waste removal system 130.

Referring back to FIG. 2, the auxiliary waste removal system 130 can advantageously be positioned proximal to the main power source. For instance, the auxiliary waste removal system 130 can be positioned on a housing (e.g., cover) of the main power source of the surface maintenance machine 100, as illustrated in FIG. 2 and connected thereto via connector elements 146 shown in FIG. 4A. Referring back to FIG. 2, the auxiliary waste removal system 130 can have an outer enclosure 138 mounted on the housing of the main power source of the surface maintenance machine 100. Such embodiments advantageously allow for compact packaging of the auxiliary waste removal system 130 within existing spaces and enclosures in the surface maintenance machine 100.

Referring again to FIG. 3, the auxiliary waste removal system 130 comprises a vacuum wand 150 that can be positioned proximal to the floor surface 120 for removing waste therefrom. In the embodiment shown in FIG. 2, the vacuum wand 150 is proximal to the operator cabin 110. For example, the vacuum wand 150 can be positioned such that an operator can grasp the vacuum wand 150 (e.g., via its handle 152) while being seated (e.g., without having to rise from their seated position) in the seat of the operator cabin 110 and operating (e.g., steering with the steering wheel 108, using the operator controls) the machine 100. In some cases, the vacuum wand 150 can be positioned to the right side 154 of a longitudinal centerline 156 of the machine 100 when viewed from the forward direction of travel 134 of the machine 100, as shown by the arrows 158 in FIG. 2. Alternatively, other positions and locations are also possible.

With continued reference to FIG. 3, the vacuum wand 150 can be fluidly coupled to a reusable bagless waste collection container 160. The bagless waste collection container is of elongate shape (e.g., elongated box shaped as illustrated), has a longitudinal axis 162 (best seen in FIG. 5). As shown therein, the longitudinal axis 162 is coaxial with the central axis 143. The bagless waste collection container can be removably coupled to the vacuum wand 150 and the vacuum source 140, such that when the waste collection container is full, or when an operator desires, the bagless waste collection container can be removed from the auxiliary waste removal system 130 and emptied. Once empty, an operator can reuse the bagless waste collection container by connecting it to the vacuum wand 150 and vacuum source 140. As such, the bagless waste collection container may not have disposable items such as vacuum bags, and therefore have a lower environmental impact than bagged vacuum systems.

Figure 5:
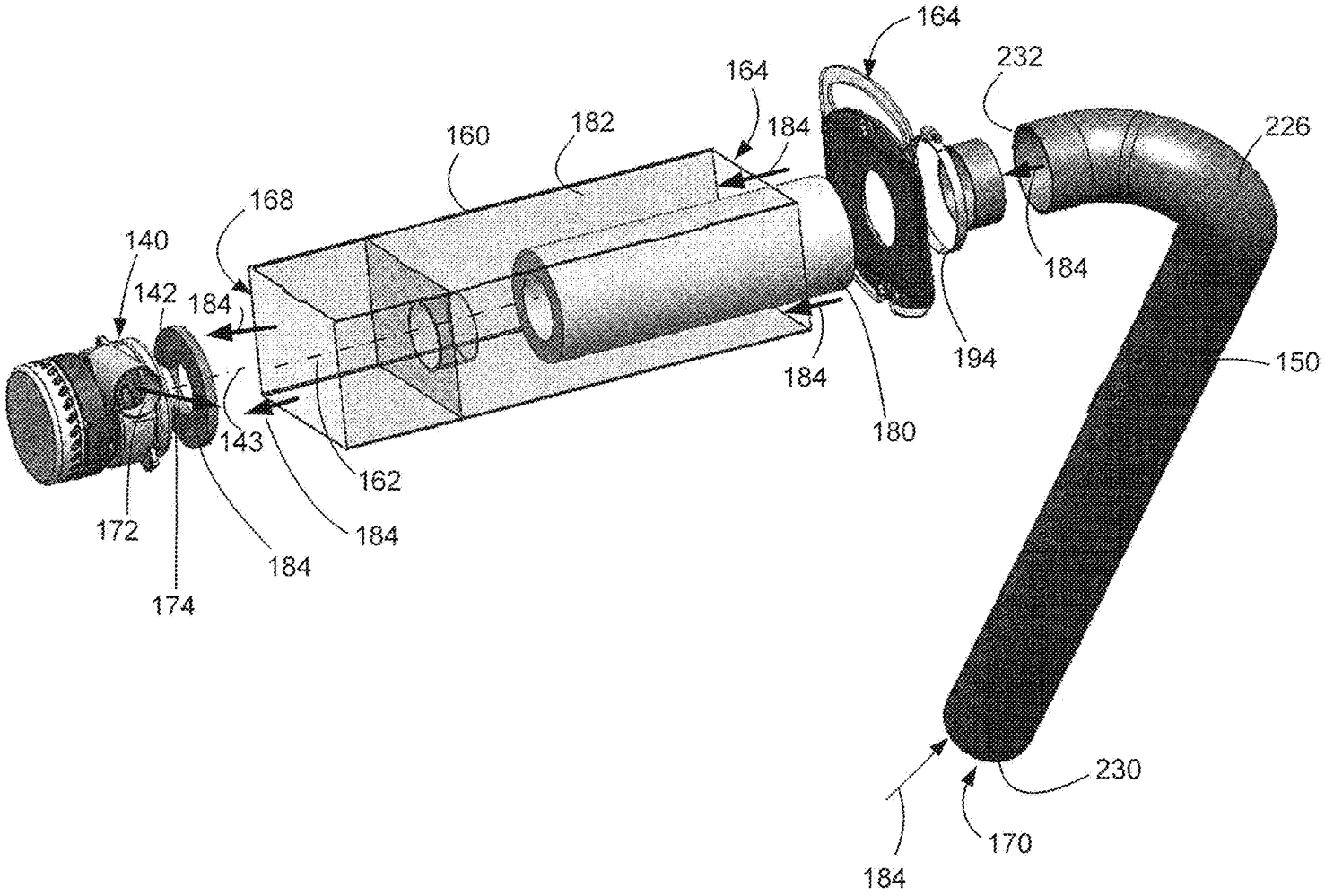
FIG. 5 is an exploded perspective view of the auxiliary waste removal system of FIG. 3.

As described previously with respect to FIG. 3, the vacuum source 140 is removably coupled to the bagless waste collection container and is in fluid communication therewith. As seen in FIG. 5, the bagless waste collection container comprises a first end 164 removably connected to the vacuum wand 150 and a second end 168 opposite to the first end 164. The second end 168 is proximal to the vacuum source 140. The vacuum source 140 generates a vacuum flow from an inlet 170 of the vacuum wand 150 (proximal to the floor surface 120) to a vacuum outlet 172. The vacuum outlet 172 can be positioned at any desired location downstream of the bagless waste collection container. For example, in the illustrated embodiment best seen in FIG. 5, the vacuum outlet 172 is positioned downstream of the intake passage 174 of the vacuum source 140 such that the waste suctioned from the floor surface 120 by the vacuum wand 150 travels along the vacuum flow path along the arrows illustrated in FIG. 5, enters the bagless waste collection container at the first end 164, and leaves the bagless waste collection container at the second end 168. The flow then travels to the vacuum outlet 172 via the intake of the vacuum source 140 and ultimately exits the auxiliary waste collection system. The waste from the floor surface 120 is therefore directly received in the bagless waste collection container for removal and disposal.

Figure 4A:
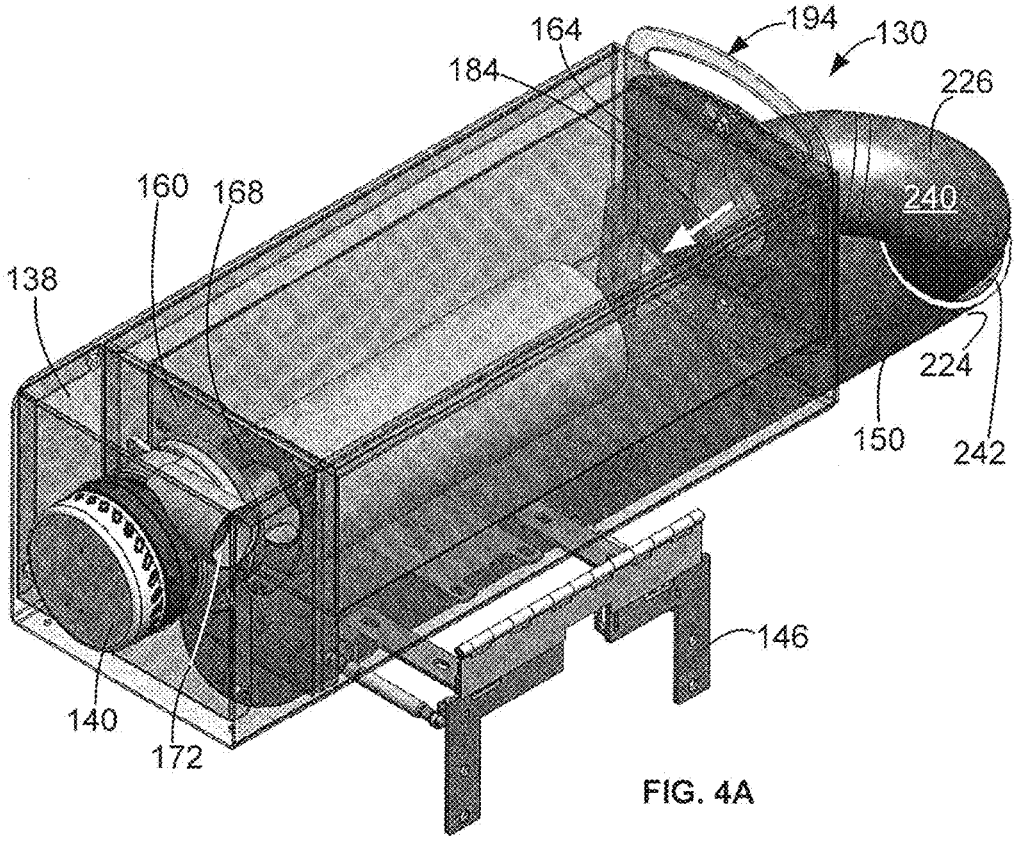
FIG. 4A is a perspective view of the auxiliary waste removal system of FIG. 3 illustrated with a transparent outer enclosure to show internal details therein.
Figure 4B:
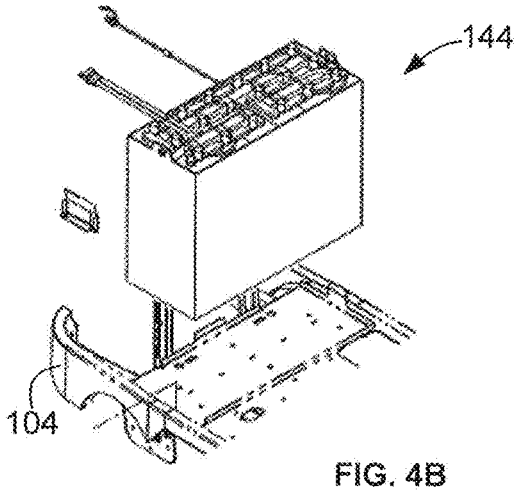
FIG. 4B is a perspective view of a main power source of the machine according to an embodiment.
Figure 6:
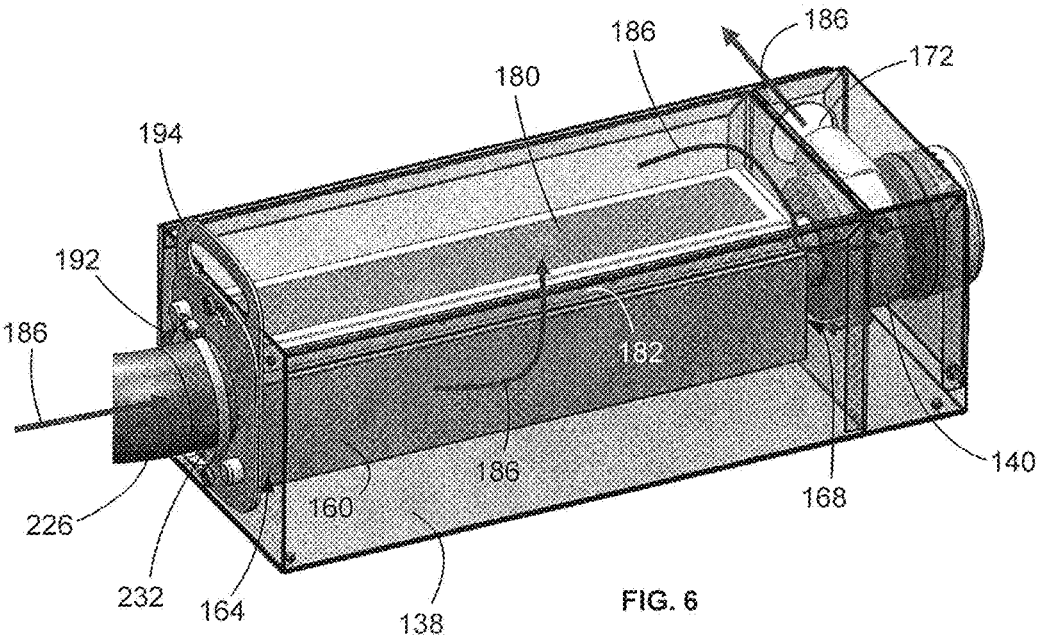
FIG. 6 is a perspective view of the auxiliary waste removal system according to another embodiment.
Figure 7:
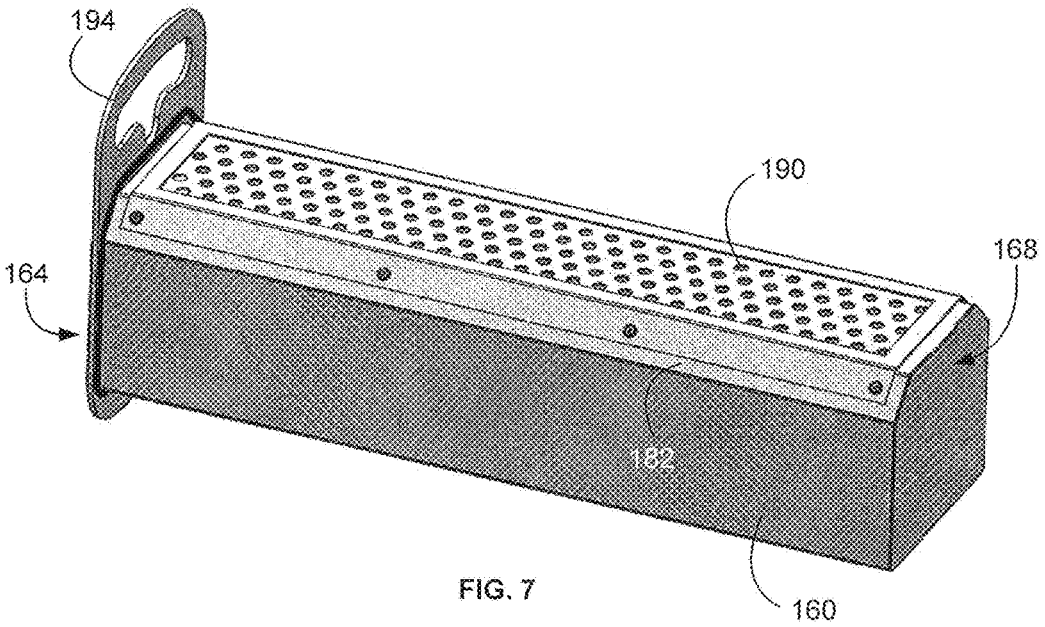
FIG. 7 is a perspective view of a bagless waste collection container of the auxiliary waste removal system of FIG. 6.

Referring now to FIGS. 5-7 and with continued reference to FIG. 4A, the auxiliary waste removal system 130 comprises one or more filters 180 for filtering debris into the bagless waste collection container by intercepting flow upstream of the vacuum outlet 172 and trapping any particles within the bagless waste collection container. In the embodiment illustrated in FIG. 4A, the one or more filters 180 are positioned within the bagless waste collection container, and coaxially with the central axis 143 of the vacuum source 140 and the longitudinal axis 162 of the bagless waste collection container 160. In the embodiment shown in FIG. 5, the one or more filters 180 are positioned on the outer surface (e.g., top surface 182) of the bagless waste collection container 160. The direction of flow in both cases is illustrated by arrows 184, 186 shown in FIGS. 5 and 6.

For instance, in FIGS. 3 and 4, the flow enters on the bagless waste collection container, and is filtered by the internally housed cylindrical filter. The filter is fixedly coupled to (e.g., by a sealant or by molding/welding) the outer enclosure 138 of the auxiliary waste removal system 130 such that when the bagless waste collection container is removed for emptying, the filter remains connected to the outer enclosure 138 of the auxiliary waste removal system 130 and consequently, to the machine 100. The cylindrical filter can, for instance, be coaxial with the vacuum source 140 (e.g., intake passage 174 of the vacuum source 140) and/or the bagless waste collection container. Any loose debris or particles are collected in the bagless waste collection container as a result of filtering, and the filtered flow leaves the auxiliary waste removal system 130 via the vacuum outlet 172.

In an alternate embodiment, as shown in FIG. 6, the filter can be housed externally to the bagless waste collection system. In such cases, the filter intercepts vacuum flow upstream of the vacuum outlet 172 and downstream of the bagless waste collection container, as flow is drawn into the bagless waste collection container, around the outer surface thereof, finally leaving via the vacuum outlet 172 as shown by arrow 186. Optionally, in such embodiments, as shown in FIG. 7, in addition to a filter, a perforated screen 190 can be provided to intercept debris larger than those that can be intercepted by the filter.

Figure 8A:
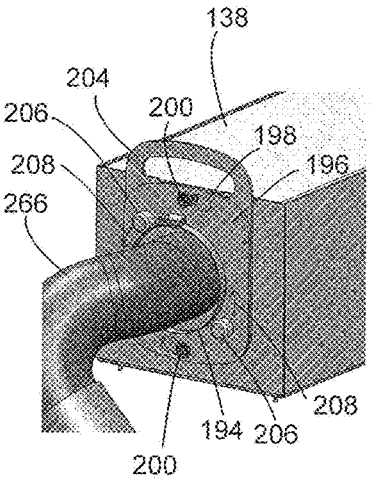
FIGS. 8A-8C illustrate a connector assembly for removably connecting the bagless waste collection container of the auxiliary waste removal system according to an embodiment.
Figure 8B:
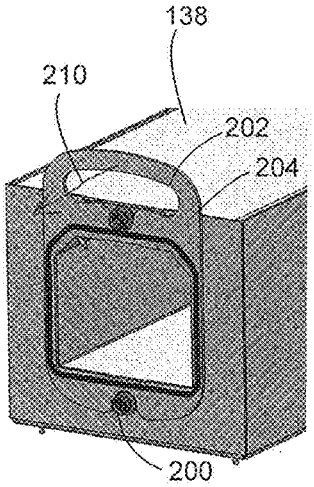
Figure 8C:
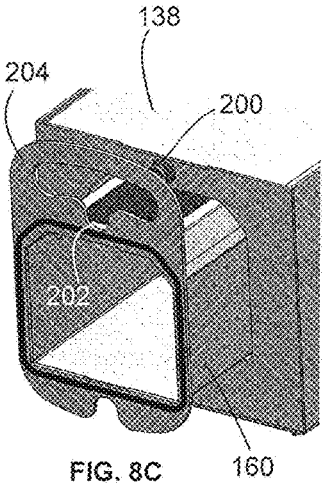

As mentioned previously, and referring to FIGS. 8A-8C, the bagless waste collection container is removably connected at its first end 164 to the vacuum wand 150. The vacuum wand 150, for instance can be clamped to the bagless waste collection container via a hose clamp 192, and a connector assembly 194. The connector assembly 194 can include a connecting plate 196 having a plurality of slots 198 that receive a plurality of fasteners 200 fixedly connected to the outer enclosure 138 of the auxiliary waste removal system 130. In turn, the plurality of fasteners 200 can be seated in a slot 202 of a receiving plate 204 integrally formed with (or otherwise attached to) the first end 164 of the bagless waste collection container. By manipulating one or more knobs 206, an operator can turn the connecting plate 196 in the direction shown by the arrows 208 in FIG. 8A, which in turn shifts the position of the slots 198 on the connecting plate 196 thereby removing it from the receiving plate 204. The receiving plate 204, can then be slid in the direction 210 shown in FIG. 8B, thereby removing the bagless waste collection container from the outer enclosure 138 of the auxiliary waste removal system 130.

As referred to previously, the vacuum wand 150 can be grasped by an operator and directed toward the floor surface 120 to collect (e.g., by suction) waste therefrom. The vacuum wand 150 can be sufficiently long such that the operator can simply grasp the wand while remaining seated in the machine 100 and extend the wand toward the floor surface 120 to remove waste from the surface. The vacuum wand 150 can be extendible and retractable between a transport position and an operating position. In the transport position, the vacuum wand 150 rests (e.g., in a recess, and secured by a holster 212 best seen in FIG. 2) on the side of the machine 100, and in the operating position, an operator removes the vacuum wand 150 (e.g., from the holster 212) and directs it toward the floor surface 120. When extended from its transport position to the operating position, the inlet 170 of the vacuum wand 150 is closer to the floor surface 120 than when the vacuum wand 150 is at its transport position.

Figure 9:
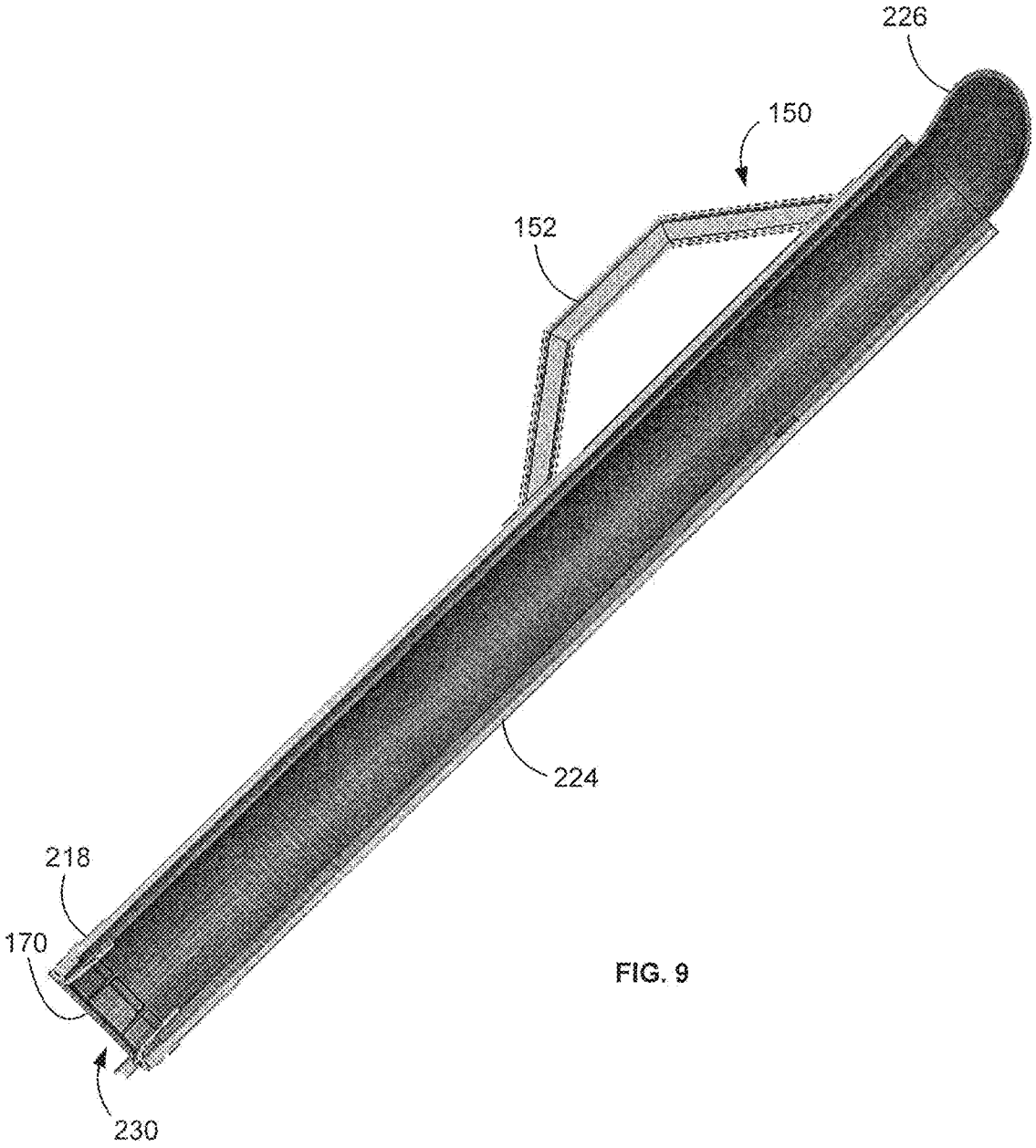
FIG. 9 is a cross-sectional view of a vacuum wand of the auxiliary waste removal system according to an embodiment.
Figure 10:
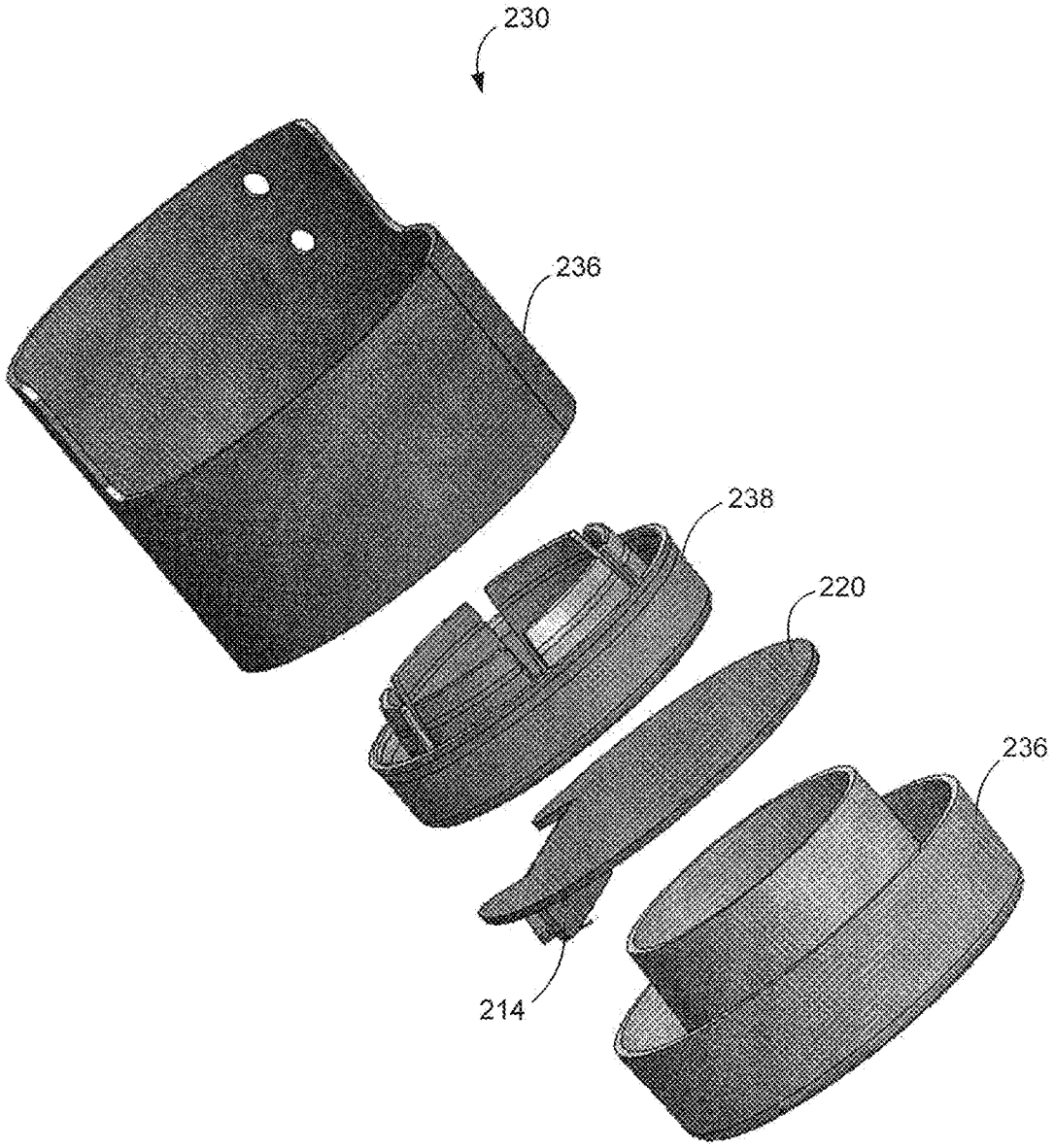
FIG. 10 is an exploded perspective view of a cuff of the vacuum wand of FIG. 9.

Referring now to FIG. 9, in some embodiments, the vacuum wand 150 comprises a position indicator coupled to the vacuum source 140 and the vacuum wand 150. The position indicator triggers the vacuum source 140 to generate the vacuum flow when the vacuum wand 150 is moved from the transport position to the operating position. For example, as shown in FIG. 10, the position indicator can be a contact switch 214 that triggers (e.g., mechanically or electrically) the vacuum source 140 (e.g., fan) to begin generating a flow, such that vacuum is maintained in the vacuum wand 150. For example, the contact switch 214 can be a proximity switch or other types of electrical switches known in the art. In the embodiment illustrated in FIGS. 9 and 10, the vacuum wand 150 has an outer cuff 218 at an end thereof. The outer cuff 218 can have a receptacle 220, which can be removed by the operator prior to use. The receptacle 220 comprises the contact switch 214 positioned thereon, and upon removal by the operator, triggers (e.g., electrically) the vacuum source 140 to begin generating a flow.

With continued reference to FIGS. 9 and 10, the vacuum wand 150 comprises an outer tube 224 and an inner hose 226 coaxially positioned therewith. Such a design can be referred to as a hose-in-tube design and advantageously allows the vacuum wand 150 to collect waste from floor surface 120 positioned further away from the operator at lengths greater than the length of the outer tube 224 of the vacuum wand 150. The inner hose 226 can also have a diameter sufficiently large to be able to sustain adequate vacuum strength for suctioning certain objects from the floor surface 120 (e.g., plastic wrap clinging to the floor surface 120). In such cases, the inner hose 226 is flexible relative to the outer tube 224. For instance, the inner hose 226 can be made of a resilient material such that the inner hose 226 is extendible to extend the vacuum wand 150 from the transport position to the operating position, and the inner hose 226 is retractable to retract the vacuum wand 150 from the operating position back to the transport position. The resilient material can have properties similar to a spring. For instance, the inner hose 226 can be helical (e.g., comprising a plurality of coils) that allow the inner hose 226 to extend and retract to desired lengths. For instance, the inner hose 226 can have a total length of between about 30 inches and about 50 inches when retracted and can extend to lengths between about 8 feet and about 15 feet. In one example, the inner hose 226 can initially be at a length of about 36 inches and when extended, extend to a length of about 10 feet. The resiliency of the inner hose 226 facilitates retracting the inner hose 226 within the outer tube 224, thereby preventing the inner hose 226 from forming loops, drooping to or hanging from the side of the machine 100, or otherwise becoming bulky or unwieldy. As such, such embodiments can facilitate compact packaging of the inner hose 226 telescopically within the outer tube 224 to reduce space requirements for the auxiliary waste removal system 130.

Referring back to FIG. 8A, the inner hose 226 comprises a first end 230 and a second end 232 opposite to the first end 230. The second end 232 of the inner hose 226 is removably coupled to the bagless waste collection container via the connector assembly 194 as described above. Referring again to FIGS. 9 and 10, the first end 230 of the inner hose 226 is fixedly connected to the outer tube 224, at the cuff. The cuff can have an outer surface 236 surrounding the outer tube 224 of the vacuum wand 150, and an inner surface 238 that can grasp (e.g., crimp) the inner hose 226 such that the outer wall 240 of the hose are flush with the inner wall 242 of the outer tube 224. When the vacuum wand 150 is extended into its operating position, the outer tube 224 and the inner hose 226 travel together toward the floor surface 120 and is proximal thereto. The outer tube 224 may not be slidable relative to the inner tube, in some examples. The vacuum wand 150 may extend and retract due to resiliency without relative motion between the outer tube 224 and the inner hose 226.

FIGS. 11-14 illustrate an auxiliary waste removal system 300 according to another embodiment. The auxiliary waste removal system 300 comprises a cover 310 inside which components of the auxiliary waste removal system are housed. The auxiliary waste removal system 300 is coupled to a vacuum wand 320 with a handle 330 for grasping and directing it toward the floor surface. Waste is suctioned from the floor surface and travels through the vacuum wand 320 and is housed in the auxiliary waste removal system 300, as was previously described with respect to FIGS. 2-7.

Figure 12:
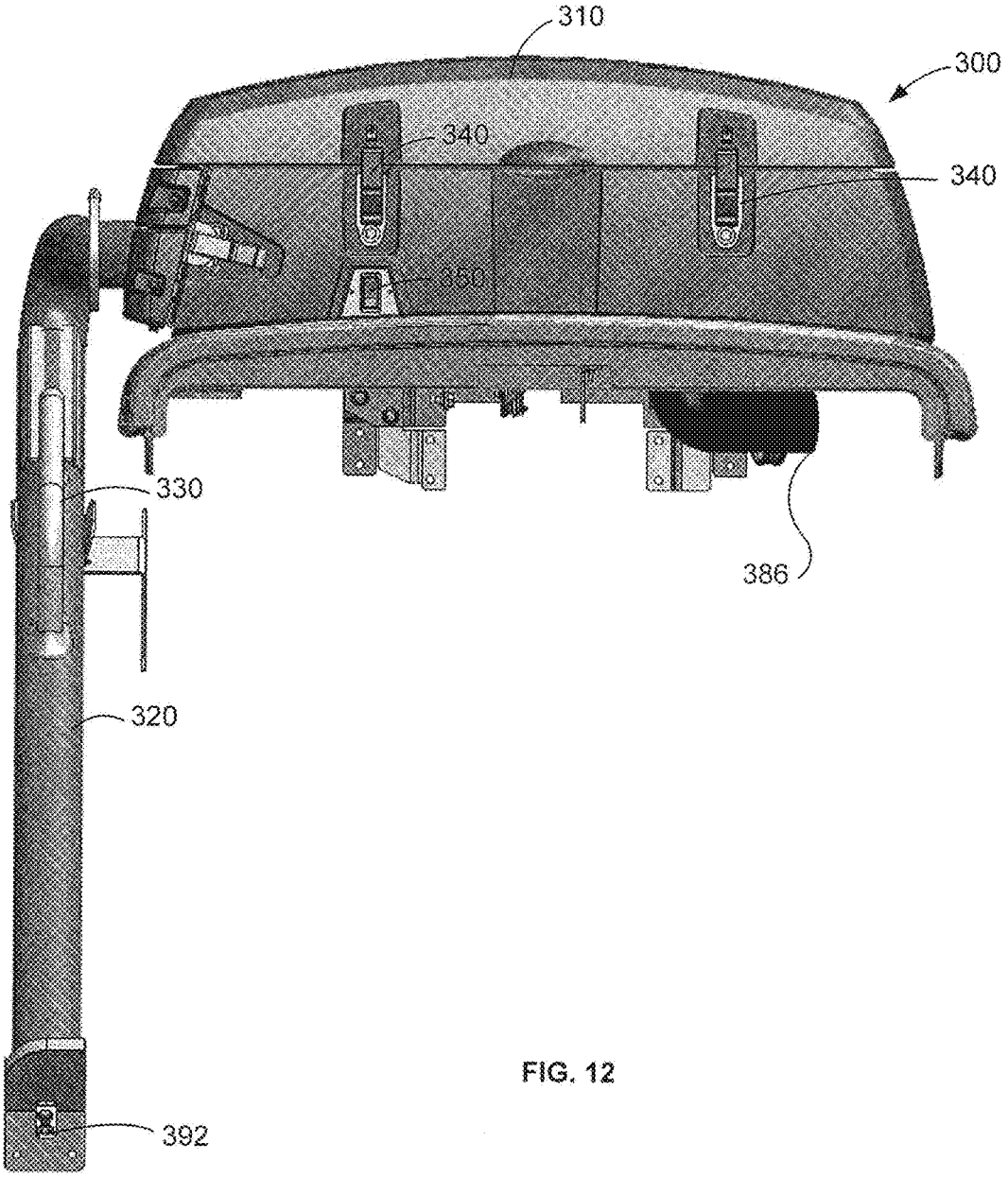
FIG. 12 is a front view of the auxiliary waste removal system of FIG. 11.

As seen in FIG. 12, the components of the auxiliary waste removal system such as waste collection container (described below) are enclosed by a cover 310 and may be accessed by opening the latches 340 of the cover 310. The cover also comprises an electrical switch 350 for controlling vacuum generation in the vacuum wand 320 as will be described further below.

Figure 13:
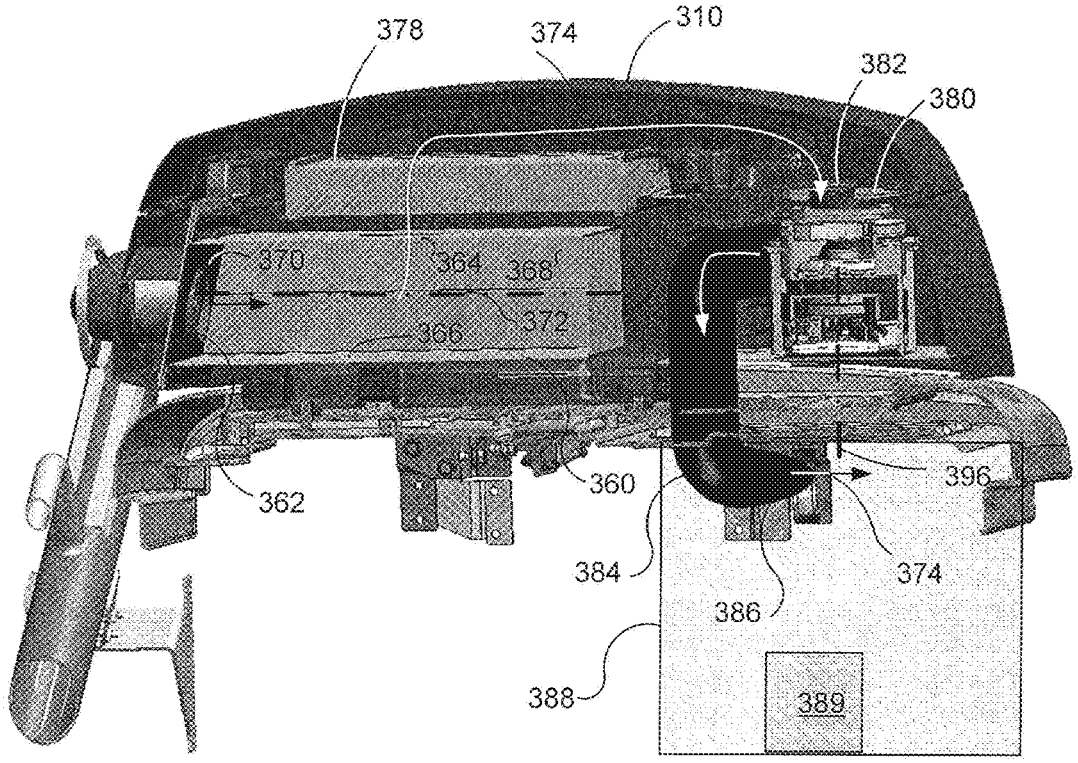
FIG. 13 is a cross-sectional front view of the auxiliary waste removal system of FIG. 11.

Referring to FIG. 13, components of the auxiliary waste removal system 300 housed inside the cover 310 include a bagless waste collection container 360. The bagless waste collection container 360 is generally elongate in shape (e.g., box-shaped) and comprises side walls 362, top wall 364, bottom wall 366 and back wall 368. The bagless waste collection container 360 also comprises a front wall not illustrated in the cross-sectional view of FIG. 13. Waste suctioned from the floor surface and travelling through the vacuum wand 330 enters the bagless waste collection container 360 through its inlet 370 seen on the left side of FIG. 13 (on the side wall 362). The bagless waste collection container 360 is disposed above a longitudinal centerline 372 generally dividing it into an upper half and a lower half. Opposite to the inlet 370 of the bagless waste collection container 360, a vacuum source 380 (such as a fan) generates suction to draw waste into the bagless waste collection container 360.

In the embodiment illustrated in FIGS. 11-14, the structure and function of the auxiliary waste removal system 300 are substantially similar to those illustrated in FIGS. 2-7 except for the differences noted below. Notably, as seen in FIG. 13, the inlet 370 of the bagless waste collection container is offset from the inlet 382 of the vacuum source 380. Likewise, the inlet 382 of the vacuum source 380 is offset from the longitudinal centerline 372 of the bagless waste collection container 360. In the illustrated embodiment shown in FIG. 13, the inlet 382 of the vacuum source 380 is disposed on a plane perpendicular to the longitudinal centerline 372 of the bagless waste collection container 360. Such a configuration facilitates improved airflow in the auxiliary waste removal system 300, thereby reducing waste from accumulating on an end of the bagless waste collection container 360 opposite to the inlet 370 and blocking airflow from the vacuum source 380 from acting on the vacuum wand 320. In addition, in the embodiments illustrated in FIG. 13, the inlet 370 of the bagless waste collection container 360 is centered about and/or inline with the longitudinal centerline 372 of the bagless waste collection container 360, and the outlet of airflow from the bagless waste collection container 360 (e.g., through the top wall 364) is offset from the longitudinal centerline 372 of the bagless waste collection container 360. Further, as seen in FIG. 13, a rotational axis 396 of the vacuum source 380 (e.g., a fan) is perpendicular to the longitudinal centerline 372 of the bagless waste collection container 360, so as to allow the vacuum source 380 optimally applying vacuum in the vacuum wand 320 without adversely being blocked by waste that may collect in the bagless waste collection container 360.

Figure 14:
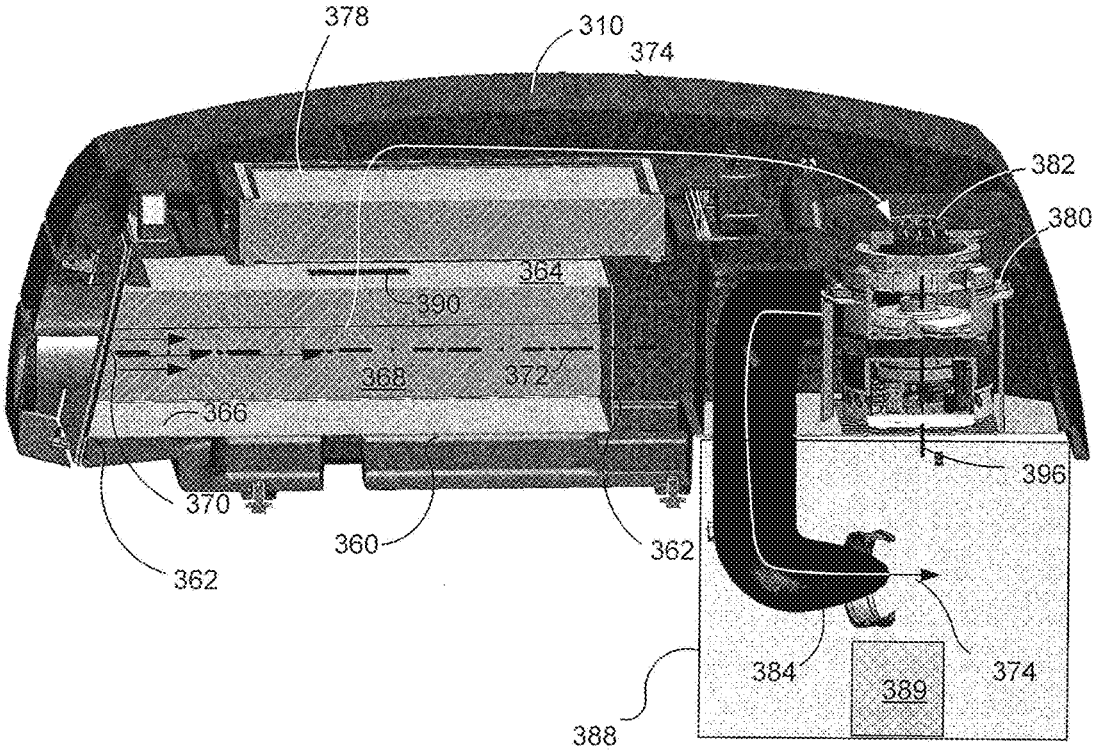
FIG. 14 is a cross-sectional top perspective view of the auxiliary waste removal system of FIG. 11.

Advantageously, the embodiments disclosed in FIGS. 11-14 provide an improved air flow path in the auxiliary waste removal system as illustrated by arrows 374 in FIG. 14, that permit airflow to enter the bagless waste collection container 360 through the inlet 370, leave the bagless waste collection container 360 (after depositing waste therein) through its top wall 364, enter the vacuum source 380 through its inlet 382, and leave the vacuum source 380 through a muffler 384 and exhaust through the exhaust port 386. Advantageously, the exhaust port 386 is located interior to the body 102 of the machine 100. In some cases, the exhaust port 386 is housed within a power enclosure 388 that houses a main power source 389 (e.g., a battery) that provides power to the wheels 108 to drive the machine on a floor surface. Such embodiments advantageously exhaust airflow to the interior of the machine to reduce a jet of exhaust leaving from the exterior of the machine. Further, the curvature of the muffler 384 and optional noise reducing means (e.g., foam) applied to the vacuum source 380 may lead to reduced noise during operation of the machine.

As seen in FIG. 13, a filtration system 378 is located downstream of the inlet 370 of the bagless waste collection container 360 and upstream of the inlet of the vacuum source 382. The filtration system 378 is offset from the longitudinal centerline 372 of the bagless waste collection container 360. In the illustrated embodiment, the filtration system 378 is located vertically above the bagless waste collection container 360 such that after depositing waste (debris, particulate and the like) in the bagless waste collection container 360, airflow passes through the filter 378 before entering the inlet 382 of the vacuum source 380. As described previously, the bagless waste collection container 360 has an elongate shape with a top wall 364 perpendicular to the side wall 362 on which inlet 370 is disposed. The filtration system 378 is positioned above the top wall 364.

Referring now to FIG. 14, as described previously, the longitudinal centerline 372 passes through the side walls 362 of the bagless waste collection container 360 to divide the bagless waste collection container 360 into an upper half and a lower half. Referring to FIG. 14, at least a portion of side walls 362 and top wall 364 of the bagless waste collection container 360 have perforations 390. For example, the upper half of the side walls 362 and an entirety of the top wall 364 may have perforations 392. The perforations can advantageously provide an increased area for airflow while reducing the possibility of waste collected in the bagless waste collection container from falling outside thereof.

Referring back to FIG. 11, as described previously with respect to the embodiments illustrated in FIGS. 2-6, the vacuum wand is held in a holster 151 operatively coupled to the body 102 of the surface maintenance machine 100 and is movable between a transport position and an operating position. In the transport position, the vacuum wand is held in the holster 151, and in the operating position, the vacuum wand is removed from the holster 151 and moved proximal to the floor surface. As was the case with the embodiments illustrated in FIG. 10, the vacuum wand 320 shown in FIGS. 11 and 12 also comprises a contact switch 392 to trigger the vacuum source 380 to begin generating vacuum flow, such that vacuum is maintained in the vacuum wand 320. In some such cases, the contact switch 392 can be a proximity switch. The contact switch 392 triggers the vacuum source 380 to maintain vacuum in the vacuum wand in the operating position. Further, the contact switch 392 shuts off the vacuum source 380 to stop generating vacuum flow in the transport position. In the embodiments illustrated in FIGS. 11 and 12 however, the machine additionally includes a master switch 350 actuable to override the contact switch 392, such that actuating the master switch 350 activates the contact switch 392 to trigger the vacuum source 380 to maintain vacuum in the vacuum wand 320 in the operating position or shut off the vacuum source to stop generating vacuum flow in the transport position. Deactivating the master switch 350 disables the contact switch 392 such that the vacuum source 380 is not activated when the vacuum wand 320 is in the operating position. Such embodiments can be beneficial when an operator may want to hold the vacuum wand 320 in the operating position without having to actually use the vacuum wand 320 for suctioning waste.

Figure 11:
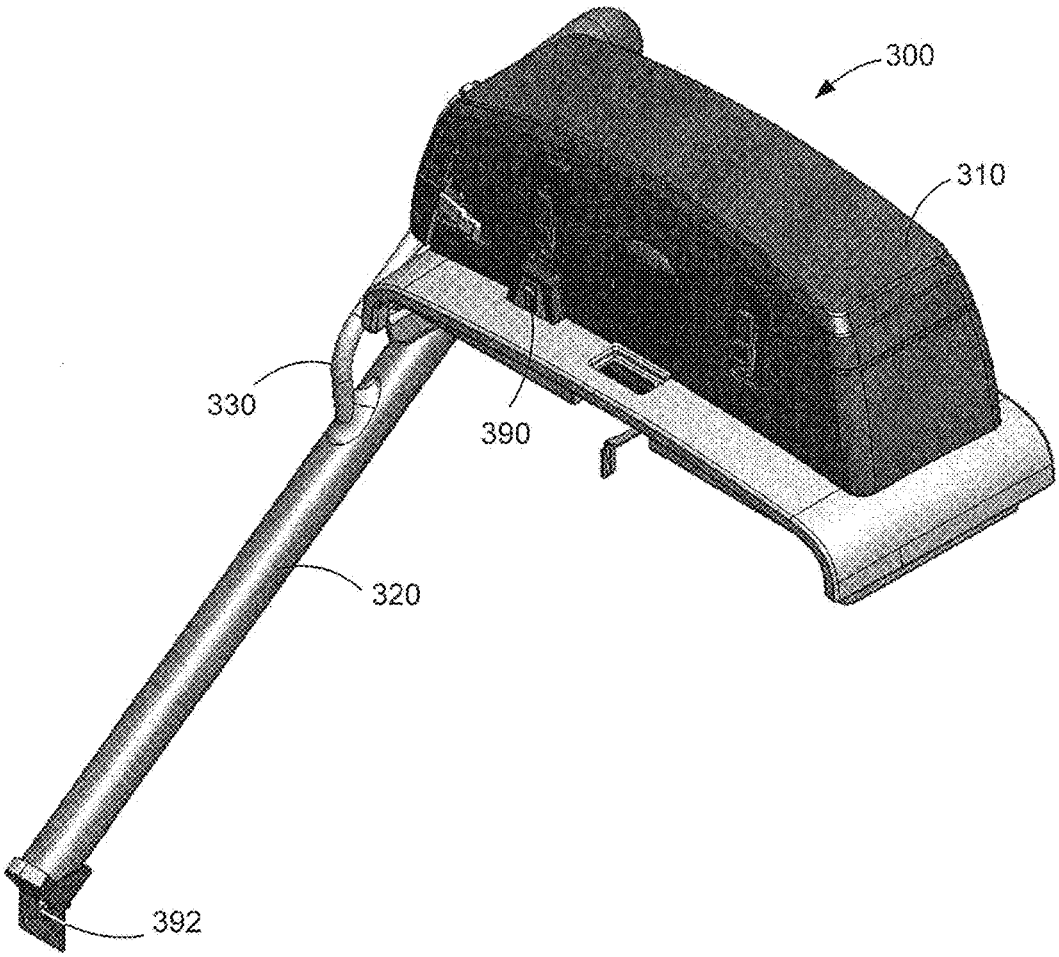
FIG. 11 is a perspective view of an auxiliary waste removal system according to another embodiment.

As seen in FIGS. 11 and 12, the master switch 392 is positioned on (e.g., an outer surface of) the auxiliary waste removal system 300 and to the rear of the transverse centerline (132, best seen in FIG. 2) of the surface maintenance machine. For example, the master switch is positioned to the rear of the operator cab (110, best seen in FIG. 2) such that the master switch is easily accessible by an operator seated in the operator cab 110.

Figure 15A:
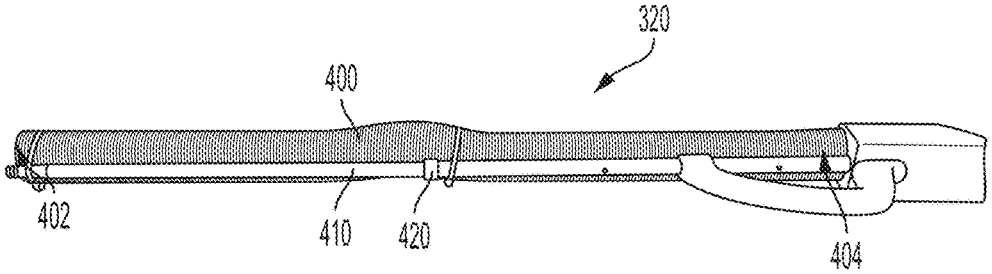
FIG. 15A is a front view of a vacuum wand of the auxiliary waste removal system of FIG. 11.
Figure 15B:
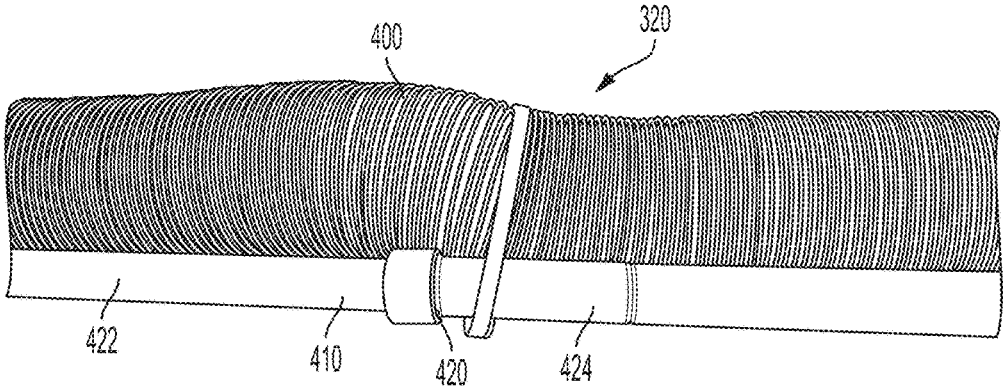
FIG. 15B is a close-up view of a central portion of the vacuum wand of FIG. 15A.

Referring now to FIGS. 15A and 15B the vacuum wand 320 is fluidly coupled to the inlet 370 of the bagless waste collection container 360 (best seen in FIG. 13). The vacuum wand 320 is flexible relative to the bagless waste collection container 360 such that the vacuum wand 320 is collapsible within its body 400 between an extendable position and a collapsible position. The vacuum wand 320 comprises a first end 402 proximal to the floor surface and a second end 404 opposite to the first end 402 coupled to the bagless waste collection container 360. The vacuum wand 320 has a flexible body 400 that can be extended or collapsed once it is removed from the holster and held by the operator in the operating position. For example, in the extendable position, the vacuum wand 320 extends past its midpoint at 420 and in the collapsible position, the portion of the vacuum wand 320 that extends past the midpoint 420 collapses (e.g., by spring action) back to its length in the collapsed position (e.g., at midpoint 420). As seen in FIGS. 15A and 15B, the flexible body 400 vacuum wand 320 is supported by (and coupled to) a telescoping spine 410 movable between the extendable position and the collapsible position, wherein in the extendable position, a column 422 of the telescoping spine 420 collapses within telescoping column 424 and thereby collapse the flexible body 400 therewith. In some cases, the body 400 comprises a flexible hose such that the telescoping spine 420 is rigid relative to the body 400 of the vacuum wand 320. Such embodiments facilitate providing better reach of the vacuum wand without adding to weight and rigidity.

In use, an operator can grasp the vacuum wand 150 (e.g., at its handle 152), and remove it from its transport position. Optionally, the operator may remove the receptacle 220 at the end of the vacuum wand 150, thereby triggering the vacuum source 140 to begin generating a flow to maintain vacuum in the vacuum wand 150. The operator can then extend the vacuum wand 150 and direct it away in a direction toward the floor surface 120. The flow generated by the vacuum source 140 can draw the waste from the floor surface 120, and as a result of the flow direction and filtering is retained in the bagless waste collection container. Once the bagless waste collection container is full, the operator can remove it from the auxiliary waste removal system 130, empty it for disposal and begin reusing the bagless waste collection container.

Embodiments described herein advantageously provide an auxiliary waste removal system 130 that is easily accessible by an operator to quickly and efficiently collect waste that are positioned outside of the cleaning path of the machine 100. Such embodiments are compactly packaged and are less bulky, while allowing the operator to collect waste from distances far away from the operator. Such embodiments also eliminate the use of bagged vacuum designs and disposable components such as vacuum bags, thereby lowering the environmental impact of the auxiliary waste removal system 130 while providing effective waste removal.

Various examples have been described. These and other examples are within the scope of the following claims.

The invention claimed is:

1. A surface maintenance machine comprising:
- a body;
- a plurality of wheels;
- a maintenance head assembly extending from an underside of the frame comprising one or more surface maintenance tools for performing a floor surface maintenance operation;
- a primary waste removal system adapted to remove waste generated from the floor surface maintenance operation; and
- an auxiliary waste removal system comprising,
  - a vacuum wand,
  - a bagless waste collection container fluidly coupled to the vacuum wand, and
  - a vacuum source fluidly coupled to the bagless waste collection container, the vacuum source generating a vacuum flow from an inlet of the vacuum wand toward an exhaust port, the exhaust port being located interior to the body of the machine.

2. The surface maintenance machine of claim 1, further comprising a power enclosure within the interior body of the machine, the power enclosure housing a main power source for providing power to the plurality of wheels to drive the machine on a floor surface, the exhaust port being located within the power enclosure.

3. The surface maintenance machine of claim 2, wherein the bagless waste collection container is elongate in shape disposed about a longitudinal centerline, an inlet of the vacuum source is positioned to be
- offset from the longitudinal centerline of the bagless waste collection container and/or
- perpendicular to the longitudinal centerline of the bagless waste collection container.

4. The surface maintenance machine of claim 2, wherein the vacuum wand comprises a first end and a second end opposite to the first end, the first end being proximal to the floor surface and the second end being operatively coupled to the bagless waste collection container.

5. The surface maintenance machine of claim 4, further comprising a holster operatively coupled to the body of the surface maintenance machine, the vacuum wand being movable between a transport position and an operating position, wherein, in the transport position, the vacuum wand is held in the holster, and in the operating position, the vacuum wand is removed from the holster and moved proximal to the floor surface.

6. The surface maintenance machine of claim 5, further comprising a contact switch adapted to trigger the vacuum source to begin generating vacuum flow, such that vacuum is maintained in the vacuum wand, wherein, the contact switch is a proximity switch.

7. The surface maintenance machine of claim 6, wherein the contact switch is configured to perform at least of the following:
- trigger the vacuum source to maintain vacuum in the vacuum wand in the operating position;
- shuts off the vacuum source to stop generating vacuum flow when in the transport position.

8. The surface maintenance machine of claim 6, further comprising, a master switch configured to be actuable to override the contact switch, wherein
- actuating the master switch activates the contact switch such that the contact switch triggers the vacuum source to maintain vacuum in the vacuum wand in the operating position and the contact switch shuts off the vacuum source to stop generating vacuum flow in the transport position; and
- deactivating the master switch disables the contact switch such that the vacuum source is not activated when the vacuum wand is in the operating position.

9. The surface maintenance machine of claim 8, wherein the master switch is positioned on the auxiliary waste removal system and/or to the rear of a transverse centerline of the surface maintenance machine.

10. The surface maintenance machine of claim 9, further comprising an operator cab positioned to the front of the transverse centerline, the operator cab adapted to house an operator, wherein the master switch is positioned to the rear of the operator cab.

11. An auxiliary waste removal system for a surface maintenance machine, comprising,
- a bagless waste collection container disposed about a longitudinal centerline; and
- a vacuum source fluidly coupled to the bagless waste collection container, the vacuum source generating a vacuum flow path defined from a bagless waste collection container inlet to a bagless waste collection container outlet, such that the waste suctioned from a floor surface travels along the vacuum flow path and is received in the bagless waste collection container,
- the bagless waste collection container inlet being in-line with the longitudinal centerline of the bagless waste collection container, and the bagless waste collection container outlet being offset from the longitudinal centerline of the bagless waste collection container.

12. The auxiliary waste removal system of claim 11, further comprising a filtration system located downstream of both the bagless waste collection container inlet and the bagless waste collection container outlet, the filtration system being offset from the longitudinal centerline of the bagless waste collection container and/or located vertically above the bagless waste collection container.

13. The auxiliary waste removal system of claim 12, wherein the bagless waste collection container has an elongate shape with a top wall, side walls perpendicular to the top wall, and a bottom wall opposite to the top wall, the inlet of the bagless waste collection container being positioned on a side wall, and the filtration system is positioned above the top wall, and wherein at least a portion of side walls and the top wall of the bagless waste collection container have perforations.

14. The auxiliary waste removal system of claim 13, wherein the longitudinal centerline passes through the side walls of the bagless waste collection container to divide the bagless waste collection container into an upper half and a lower half, wherein the upper half of the side walls have perforations, the perforations forming at least part of the bagless waste collection container outlet.

15. The auxiliary waste removal system of claim 14, wherein an entirety of the top wall has perforations.

16. The auxiliary waste removal system of claim 11, wherein a rotational axis of the vacuum source is perpendicular to the longitudinal centerline of the bagless waste collection container.

17. The auxiliary waste removal system of claim 11, wherein the bagless waste collection container is removable from the auxiliary waste removal system and/or the bagless waste collection container is reusable.

18. An auxiliary waste removal system for a surface maintenance machine, comprising, a waste collection container; and a vacuum source fluidly coupled to the waste collection container, the vacuum source generating a vacuum flow path defined from a waste collection container inlet to a waste collection container outlet, such that the waste suctioned from a floor surface travels along the vacuum flow path and is received in the waste collection container; and a vacuum wand fluidly coupled to and upstream of the waste collection container inlet, the vacuum wand being supported by a telescoping spine configured to be collapsible or extensible, such that the vacuum wand collapses or extends with the telescoping spine, wherein a handle extends out from a longitudinal axis of the telescoping spine, and wherein the vacuum wand includes a contact switch at or near an end of the vacuum wand opposite the waste collection container inlet, the contact switch configured to trigger the vacuum source when the vacuum wand is in the operating position.

19. The auxiliary waste removal system of claim 18, wherein the vacuum wand is flexible relative to the waste collection container.

20. The auxiliary waste removal system of claim 18, wherein the vacuum wand comprises a flexible hose and the telescoping spine is rigid relative to the vacuum wand, the flexible hose has a longitudinal axis, the longitudinal axis of the flexible hose being offset from the longitudinal axis of the telescoping spine.

21. The auxiliary waste removal system of claim 20, wherein a cross-sectional area of the telescoping spine is less than a cross-sectional area of the flexible hose.

22. The auxiliary waste removal system of claim 20, wherein the entirety of the telescoping spine is positioned exterior to the flexible hose.

23. The auxiliary waste removal system of claim 20, wherein the telescoping spine is connected to the exterior of the flexible hose.

* * * * *